US010705443B2

(12) United States Patent
Iwaki et al.

(10) Patent No.: US 10,705,443 B2
(45) **Date of Patent: *Jul. 7, 2020**

(54) IMAGE FORMING APPARATUS AND NON-TRANSITORY COMPUTER READABLE MEDIUM STORING PROGRAM

(71) Applicant: FUJI XEROX CO., LTD., Tokyo (JP)

(72) Inventors: Kaori Iwaki, Kanagawa (JP); Masahiko Kubo, Kanagawa (JP); Ayako Watanabe, Kanagawa (JP); Kaoru Yamauchi, Kanagawa (JP); Yosuke Tashiro, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/507,351

(22) Filed: Jul. 10, 2019

(65) Prior Publication Data

US 2019/0332028 A1 Oct. 31, 2019

Related U.S. Application Data

(63) Continuation of application No. 15/946,148, filed on Apr. 5, 2018, now Pat. No. 10,353,313.

(30) Foreign Application Priority Data

Sep. 8, 2017 (JP) ..... 2017-173092

(51) Int. Cl.

| | |
|---|---|
| ***G03G 15/22*** | (2006.01) |
| ***G03G 15/01*** | (2006.01) |
| ***G03G 15/05*** | (2006.01) |
| ***G03G 15/16*** | (2006.01) |
| ***G03G 15/00*** | (2006.01) |

(52) U.S. Cl.

CPC ..... *G03G 15/011* (2013.01); *G03G 15/0131* (2013.01); *G03G 15/05* (2013.01); *G03G 15/1605* (2013.01); *G03G 15/6585* (2013.01)

(58) Field of Classification Search

CPC .... G03G 15/011; G03G 15/131; G03G 15/05; G03G 15/1605; G03G 15/6585

See application file for complete search history.

(56) References Cited

U.S. PATENT DOCUMENTS

2011/0182607 A1* 7/2011 Takemura ..... G03G 15/6585 399/67

2014/0255053 A1* 9/2014 Ohshika ..... G03G 15/6585 399/53

FOREIGN PATENT DOCUMENTS

JP 2012-37732 A 2/2012

* cited by examiner

*Primary Examiner* — Hoang X Ngo

(74) *Attorney, Agent, or Firm* — Sughrue Mion, PLLC

(57) ABSTRACT

An image forming apparatus includes an image forming component that forms an image on a recording medium by using a white color material and a color material other than the white color material, and a controller that controls a color material amount of the white color material to differ depending on a position where an image that uses the white color material is formed in order of formation of images that use respective color materials in the image forming component.

12 Claims, 12 Drawing Sheets

FIG. 9

| RECORDING MEDIUM | TONER AMOUNT OF WHITE TONER |
|---|---|
| TRANSPARENT FILM (WHITE TONER IN LOWERMOST LAYER) | 80% |
| BLACK PAPER (WHITE TONER IN LOWERMOST LAYER) | 90% |
| TRANSPARENT FILM (WHITE TONER IN UPPERMOST LAYER) | 100% |

FIG. 10

| TONER AMOUNT OF WHITE TONER / RECORDING MEDIUM | 100% | 90% | 80% |
|---|---|---|---|
| TRANSPARENT FILM (WHITE TONER IN LOWERMOST LAYER) | C | B | A |
| BLACK PAPER (WHITE TONER IN LOWERMOST LAYER) | C | A | A |
| TRANSPARENT FILM (WHITE TONER IN UPPERMOST LAYER) | A | A | A |

FIG. 12

| TONER AMOUNT OF WHITE TONER / RECORDING MEDIUM | 100% | 90% | 80% |
|---|---|---|---|
| TRANSPARENT FILM (WHITE TONER IN LOWERMOST LAYER) | A | A | A |
| BLACK PAPER (WHITE TONER IN LOWERMOST LAYER) | A | A | C |
| TRANSPARENT FILM (WHITE TONER IN UPPERMOST LAYER) | A | A | B |

IMAGE FORMING APPARATUS AND NON-TRANSITORY COMPUTER READABLE MEDIUM STORING PROGRAM

CROSS-REFERENCE TO RELATED APPLICATIONS

This application is a continuation of U.S. application Ser. No. 15/946,148 filed Apr. 5, 2018, which is based on and claims priority under 35 USC 119 from Japanese Patent Application No. 2017-173092 filed Sep. 8, 2017.

BACKGROUND

Technical Field

The present invention relates to an image forming apparatus and a non-transitory computer readable medium storing a program.

SUMMARY

According to an aspect of the invention, there is provided an image forming apparatus including an image forming component that forms an image on a recording medium by using a white color material and a color material other than the white color material, and a controller that controls a color material amount of the white color material to differ depending on a position where an image that uses the white color material is formed in order of formation of images that use respective color materials in the image forming component.

BRIEF DESCRIPTION OF THE DRAWINGS

An exemplary embodiment of the present invention will be described in detail based on the following figures, wherein:

FIG. 9 illustrates examples of the toner amount of a white toner suitable to suppress toner splashing during transfer and to secure concealability;

FIG. 10 illustrates a relationship among the type of the recording medium, the toner amount of the white toner, and the toner splashing;

FIG. 12 illustrates a relationship among the type of the recording medium, the toner amount of the white toner, and the concealability as results of experiments in FIGS. 11A to 11C;

DETAILED DESCRIPTION

An exemplary embodiment of the present invention is described in detail with reference to the drawings.

Figure 1:
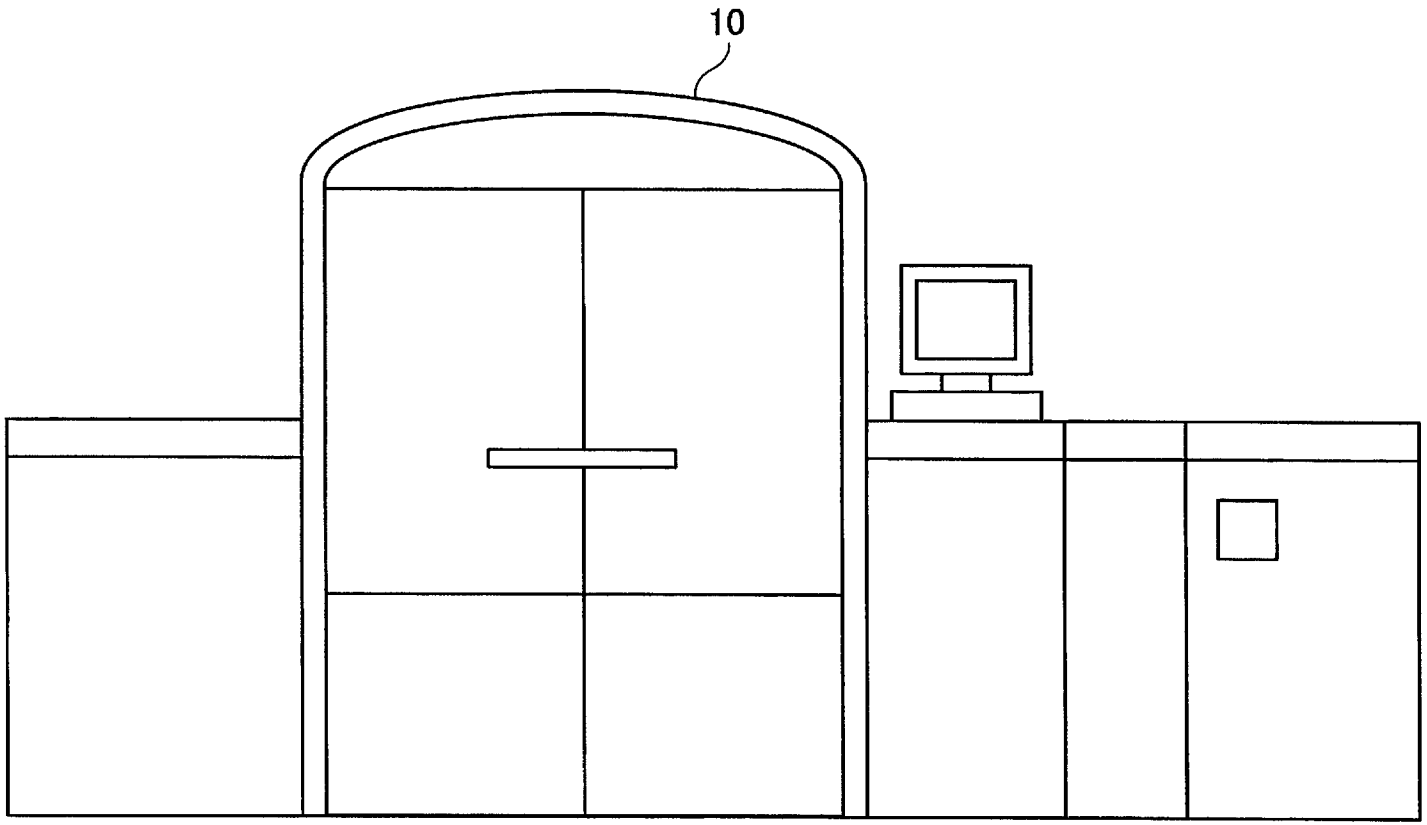
FIG. 1 illustrates the structure of an external appearance of an image forming apparatus according to one exemplary embodiment of the present invention.

FIG. 1 illustrates the structure of an external appearance of an image forming apparatus 10 according to one exemplary embodiment of the present invention.

As illustrated in FIG. 1, the image forming apparatus 10 of this exemplary embodiment is a so-called production printer for use in business printing. The production printer has a function of executing high-speed printing with high image quality.

Figure 2:
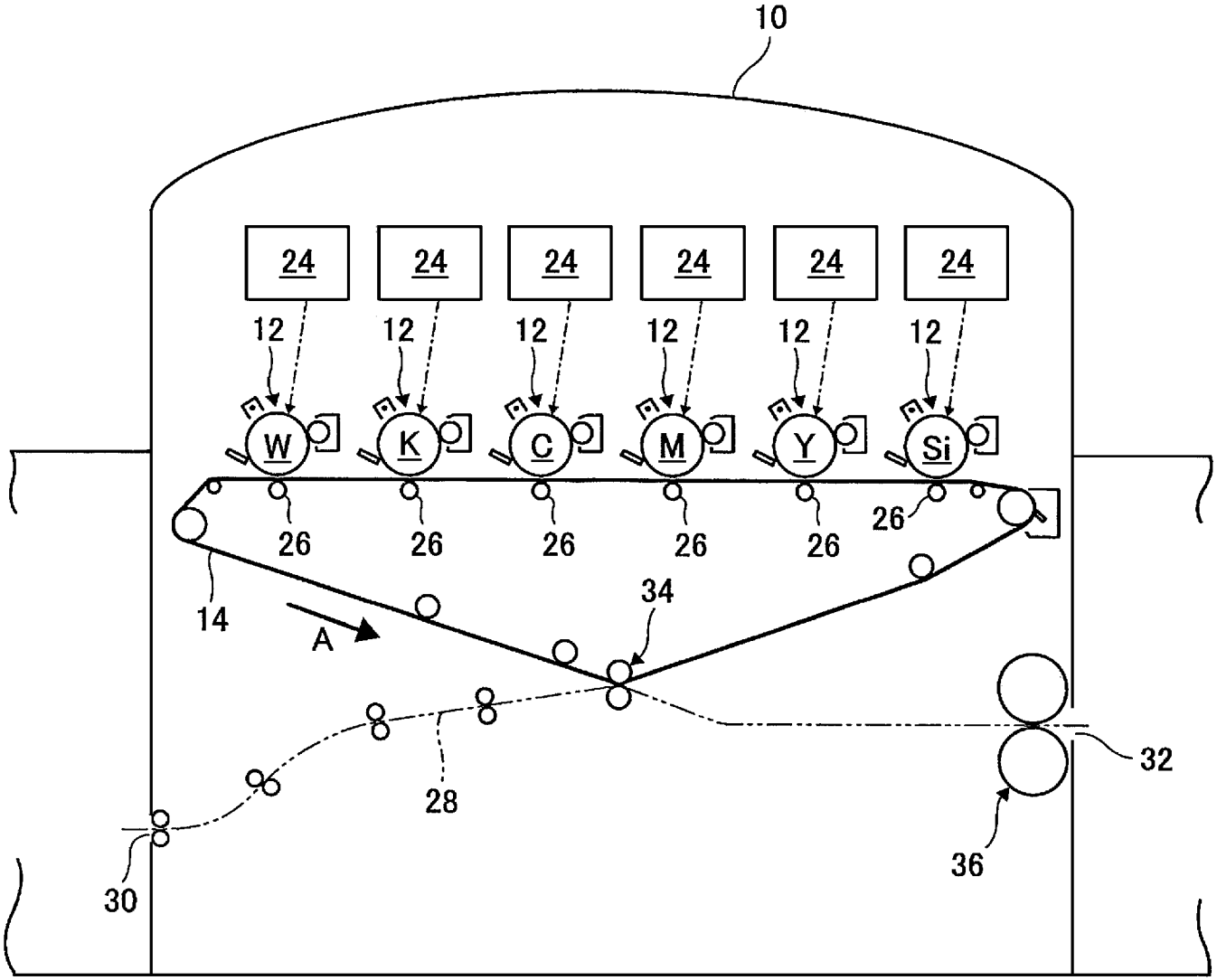
FIG. 2 illustrates the internal structure of a body of the image forming apparatus.

The internal structure of a body of the image forming apparatus 10 is described with reference to FIG. 2 and FIG. 3. As illustrated in FIG. 2, the image forming apparatus 10 includes six image forming units 12. The six image forming units 12 are respectively configurated to form images on a recording medium by using basic color toners that are yellow (Y), magenta (M), cyan (C), and black (K) toners and two special color toners.

Examples of the special color toner include metallic (metallic luster color) toners such as a silver toner (Si) and a gold toner (G), a transparent toner, and a white toner (W). Two toners may be selected for use from among those special color toners. FIG. 2 illustrates a case in which the silver toner (Si) and the white toner (W) are selected from among those special color toners and are set at both ends of the array of the basic color toners.

This exemplary embodiment is directed to a case of controlling the toner amount of the white toner when the white toner and the basic color toners are used without using the silver toner out of the two special color toners and a white toner image is formed as a background for basic color toner images.

The toner amount refers to an amount of toner, for example, a weight of toner ($g/m^2$) to be used on a recording medium per unit area. In the following description, the ratio of the toner amount of each color to be used in printing is expressed as a percent (toner coverage), provided that the maximum value of the toner amount of each color to be used per unit area, for example, per pixel is 100%.

Figure 3:
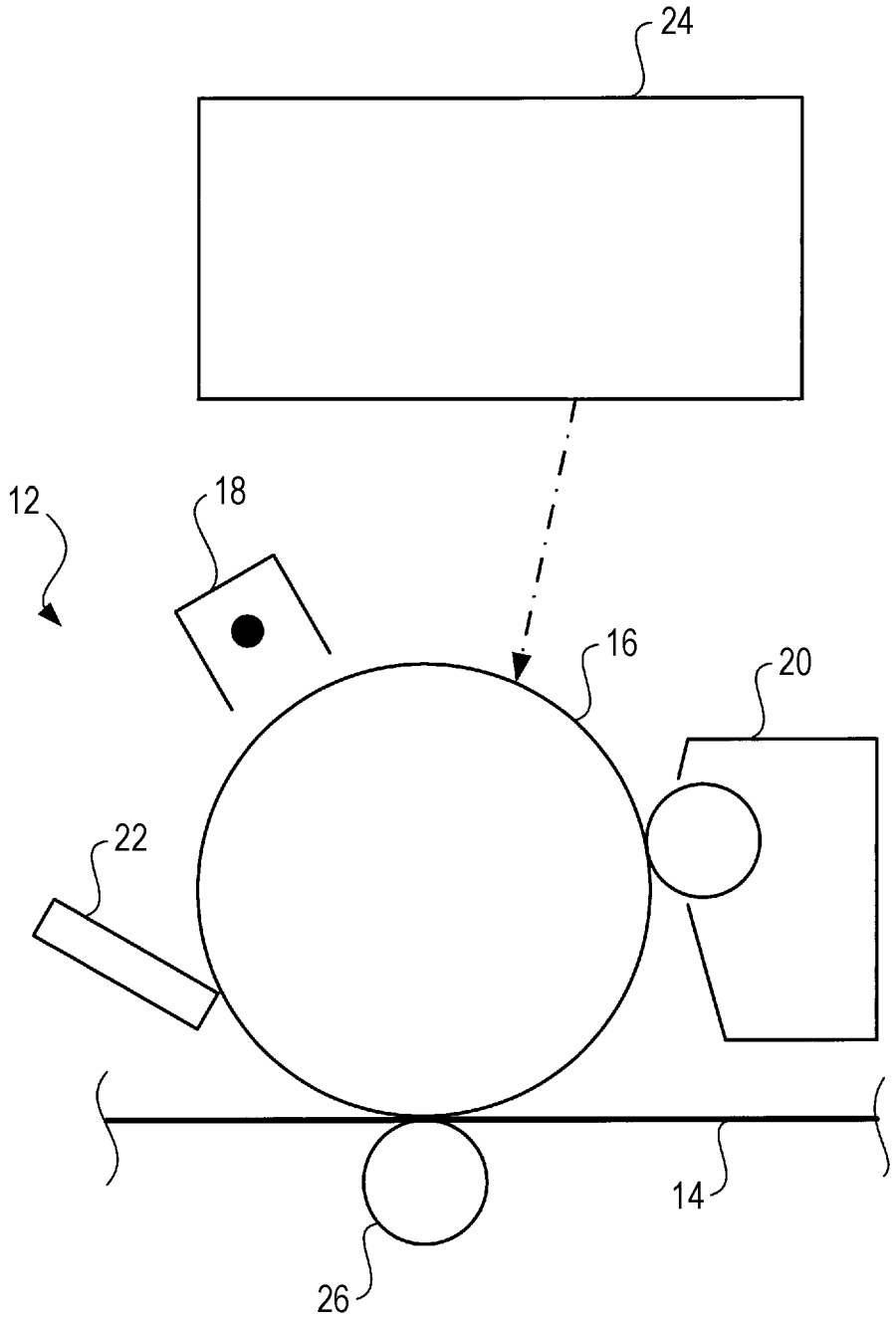
FIG. 3 illustrates an image forming unit of the image forming apparatus.

As illustrated in FIG. 3, each image forming unit 12 includes a photoconductor drum 16, a charging device 18 serving as a charging component that uniformly charges the surface of the photoconductor drum 16, a developing device 20 that develops an electrostatic latent image formed on the photoconductor drum 16, and a cleaning device 22. The photoconductor drum 16 is a cylindrical image carrier that carries a toner image (developer image). The photoconductor drum 16 is uniformly charged by the charging device 18 and an electrostatic latent image is formed on the photoconductor drum 16 by laser light radiated from an optical scanning apparatus 24. The electrostatic latent image formed on the photoconductor drum 16 is developed by the developing device 20 with toner and the toner image is transferred onto an intermediate transfer belt 14. Residual toner or paper dust adhering to the photoconductor drum 16 after the toner image transfer step is removed by the cleaning device 22.

The intermediate transfer belt 14 rotates in a direction of the arrow A in FIG. 2. That is, the intermediate transfer belt 14 is looped by a predetermined tension over plural support rollers that support the intermediate transfer belt 14. First transfer rollers 26 are respectively arranged at positions that face the photoconductor drums 16 across the intermediate transfer belt 14. The first transfer roller 26 transfers, onto the intermediate transfer belt 14, each color toner image that is formed on the photoconductor drum 16.

A transport path 28 along which a recording medium is transported is formed below the intermediate transfer belt 14. The transport path 28 is provided with plural transport rollers that transport the recording medium from an entrance port 30 to an output port 32. A second transfer device 34 that secondly transfers the toner images, which are firstly transferred from the photoconductor drums 16 onto the intermediate transfer belt 14, onto the recording medium transported along the transport path 28 is provided in the transport path 28 below the intermediate transfer belt 14. A fixing device 36 is provided on a downstream side in the recording medium transport direction with respect to the second transfer device 34. The fixing device 36 fixes, with heat and pressure, the toner images transferred onto the recording medium. The recording medium onto which the images have been fixed by the fixing device 36 is output from the output port 32.

Figure 4:
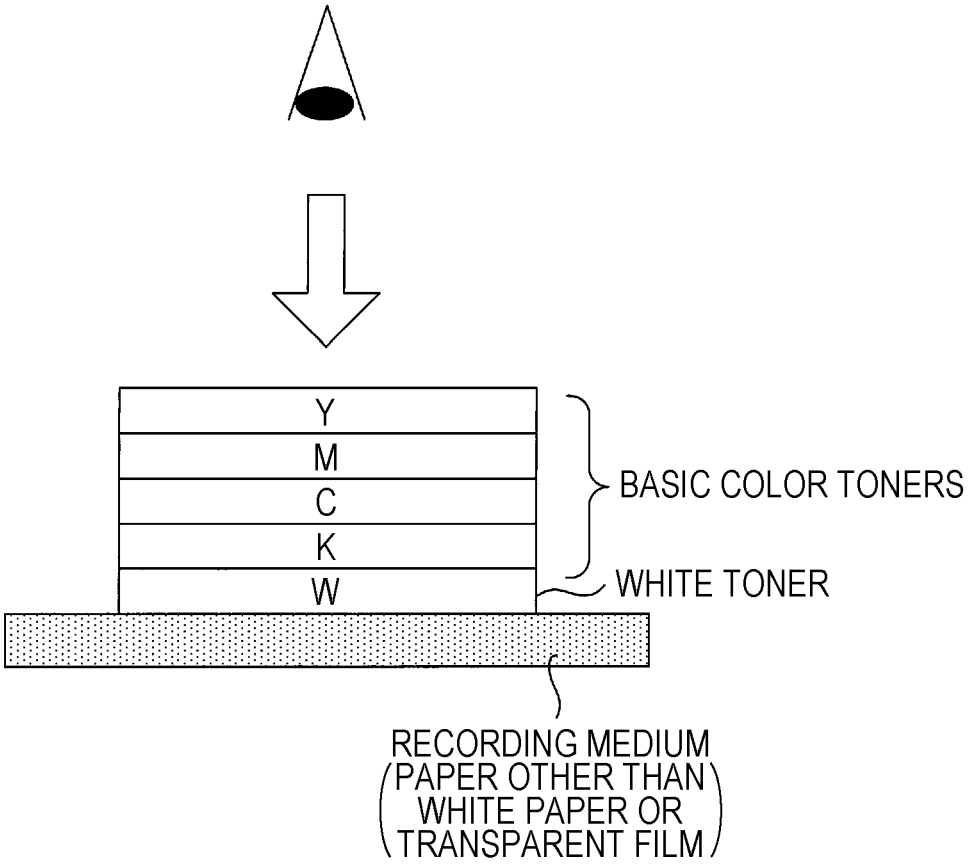
FIG. 4 is an enlarged sectional view of a principal part of a recording medium on which images are formed in the order illustrated in FIG. 2 and illustrates a case in which the images on the recording medium are viewed from a side where the images are formed.

When the silver toner (Si), the yellow toner (Y), the magenta toner (M), the cyan toner (C), the black toner (K), and the white toner (W) are set on the six image forming units 12 in this order as illustrated in FIG. 2, the toner images are formed in this order through the first transfer while being superposed on the intermediate transfer belt 14. The toner images are secondly transferred from the intermediate transfer belt 14 onto the recording medium in a collective manner by the second transfer device 34. In this case, as illustrated in FIG. 4, the color images are formed while being superposed on the recording medium in the order of the white toner (W), the black toner (K), the cyan toner (C), the magenta toner (M), and the yellow toner (Y). That is, the white toner image is formed in the lowermost layer on the recording medium and the toner images on the recording medium are viewable from a side where the toner images are formed.

Therefore, when the color toner images are formed in the order illustrated in FIG. 4, influence of the color of the recording medium or the color of an object behind the recording medium is concealed by the white toner image even if the recording medium is paper other than white paper or is a transparent film. As a result, the coloring of the images formed by using the basic color toners is maintained as the original coloring. The transparent film is an example of a recording medium through which the toner images are viewable from a side opposite to a side where the toner images are formed.

Figure 5:
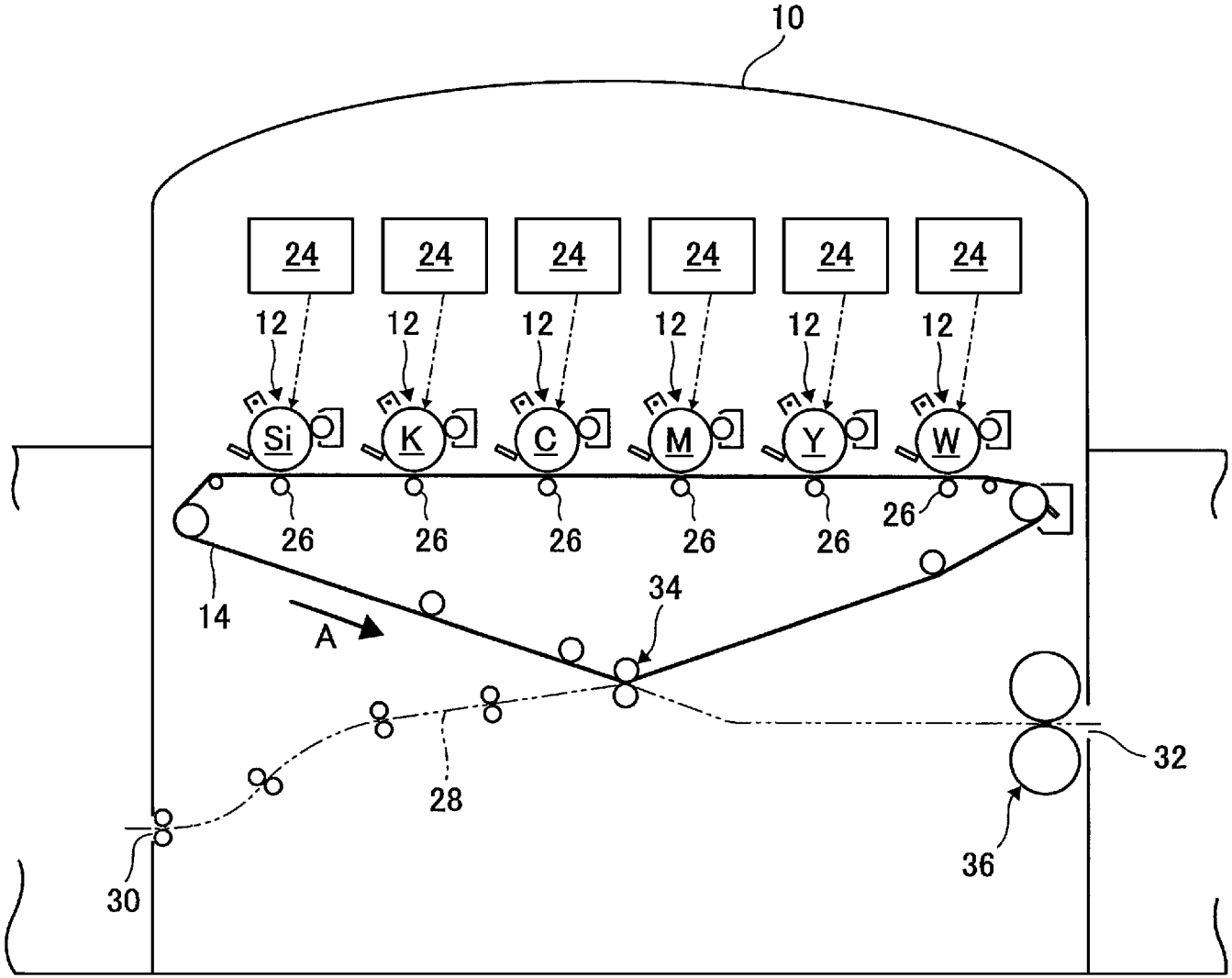
FIG. 5 illustrates the internal structure of the body of the image forming apparatus.
Figure 6:
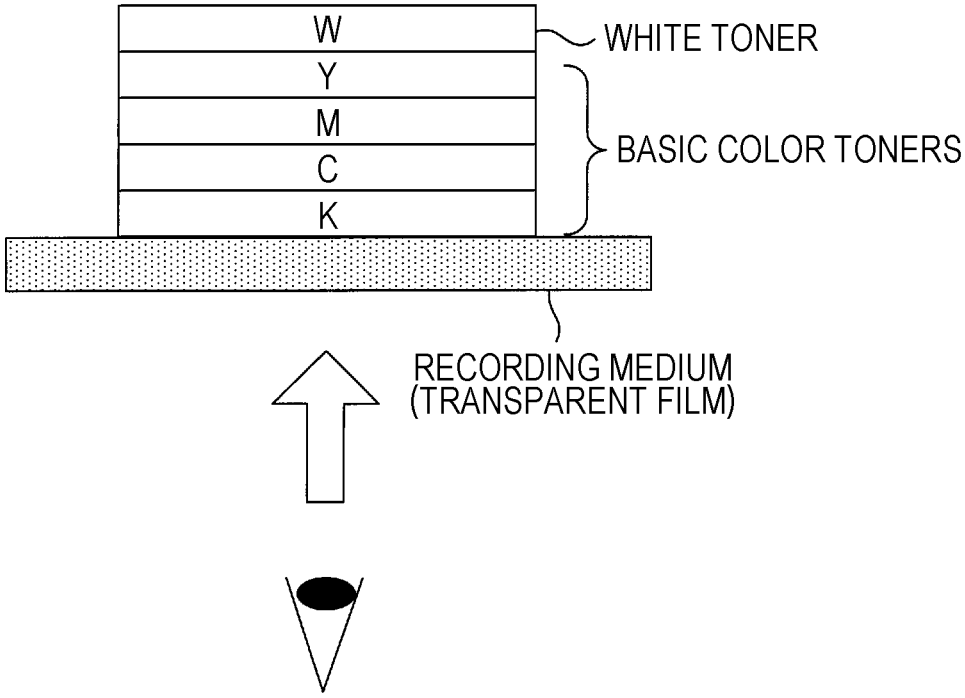
FIG. 6 is an enlarged sectional view of a principal part of a recording medium on which images are formed in the order illustrated in FIG. 5 and illustrates a case in which the images on the recording medium are viewed from a side opposite to a side where the images are formed.

When the toner images are formed so as to be viewable through the recording medium such as a transparent film from the side opposite to the side where the toner images are formed, the special color toners are interchanged in use. That is, as illustrated in FIG. 5, the image forming units 12 for the white toner and the silver toner are interchanged in use. When the white toner (W), the yellow toner (Y), the magenta toner (M), the cyan toner (C), the black toner (K), and the silver toner (Si) are set on the six image forming units 12 in this order as illustrated in FIG. 5, the toner images are formed in this order through the first transfer while being superposed on the intermediate transfer belt 14. The toner images are secondly transferred from the intermediate transfer belt 14 onto the recording medium in a collective manner by the second transfer device 34. In this case, as illustrated in FIG. 6, the color images are formed while being superposed on the recording medium in the order of the black toner (K), the cyan toner (C), the magenta toner (M), the yellow toner (Y), and the white toner (W). That is, the white toner image is formed in the uppermost layer on the recording medium and the toner images on the recording medium are viewable from the side opposite to the side where the toner images are formed.

Therefore, when the color toner images are formed in the order illustrated in FIG. 6, the influence of the color of an object behind the recording medium such as a transparent film is concealed by the white toner image even if the images formed by using the basic color toners are viewed through the recording medium. As a result, the coloring of the images formed by using the basic color toners is maintained as the original coloring.

The yellow (Y), magenta (M), cyan (C), and black (K) toners other than the white toner are hereinafter described as the basic color toners. The order of the basic color toners is not limited to the order described above but is changeable as appropriate.

Figure 7:
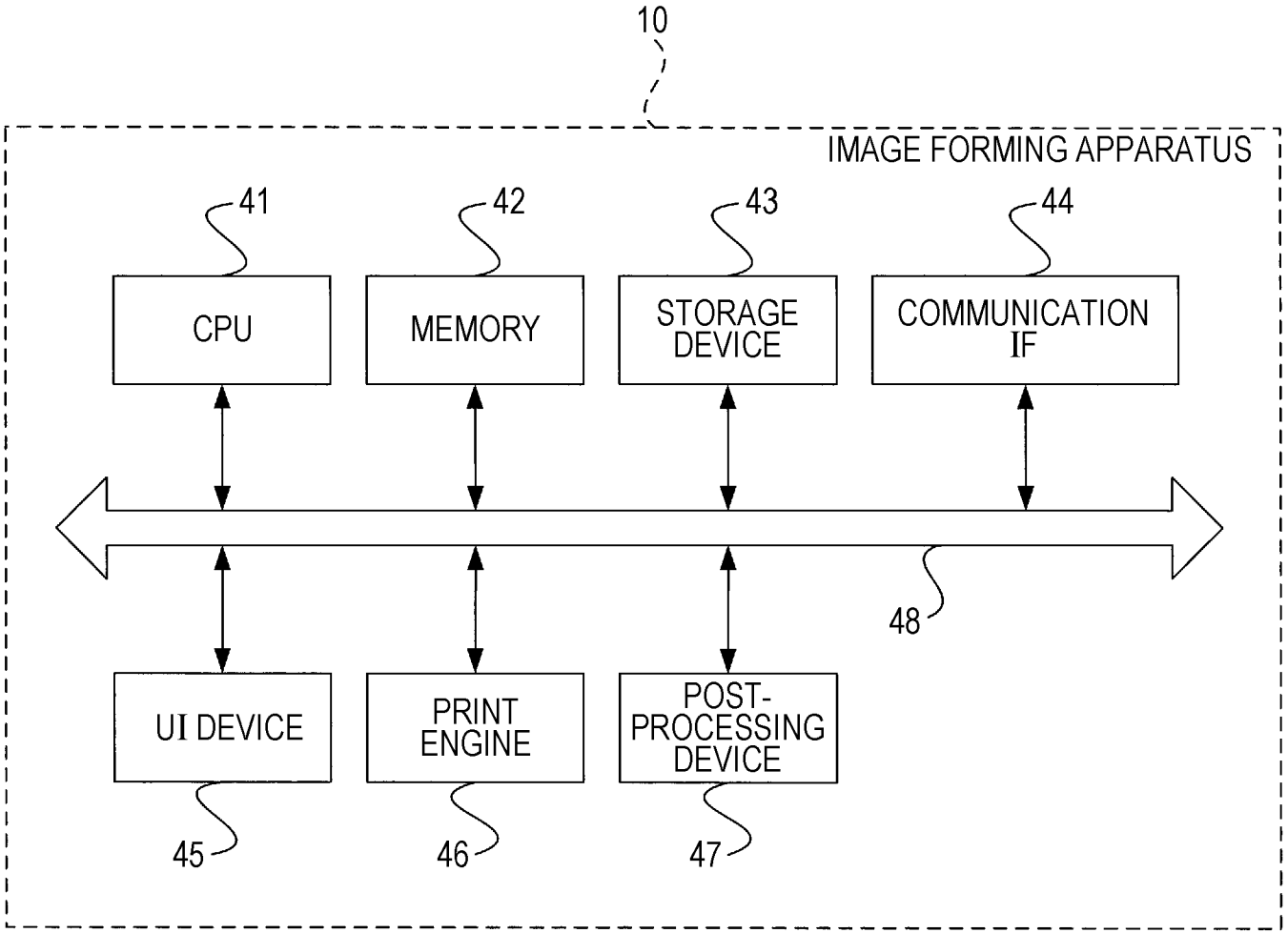
FIG. 7 is a block diagram illustrating the hardware configuration of the image forming apparatus according to the exemplary embodiment of the present invention.

FIG. 7 illustrates the hardware configuration of the image forming apparatus 10 of this exemplary embodiment.

As illustrated in FIG. 7, the image forming apparatus 10 includes a CPU 41, a memory 42, a storage device 43 such as a hard disk drive (HDD), a communication interface (IF) 44 that transmits and receives data to and from an external apparatus or the like via a network, a user interface (UI) device 45 including a touch panel or a liquid crystal display and a keyboard, a print engine 46, and a post-processing device 47. Those constituent elements are connected to each other via a control bus 48.

The print engine 46 prints an image on a recording medium such as print paper through charging, exposing, developing, transferring, and fixing steps.

The post-processing device 47 executes various types of post-processing such as stapling, punching, or folding for the paper subjected to printing performed by the print engine 46.

The CPU 41 controls the operation of the image forming apparatus 10 by executing predetermined processing based on a control program stored in the memory 42 or the storage device 43. This exemplary embodiment is described under the assumption that the CPU 41 executes the control program by reading the control program stored in the memory 42 or the storage device 43. The program may be provided to the CPU 41 by being stored in a storage medium such as a CD-ROM.

Figure 8:
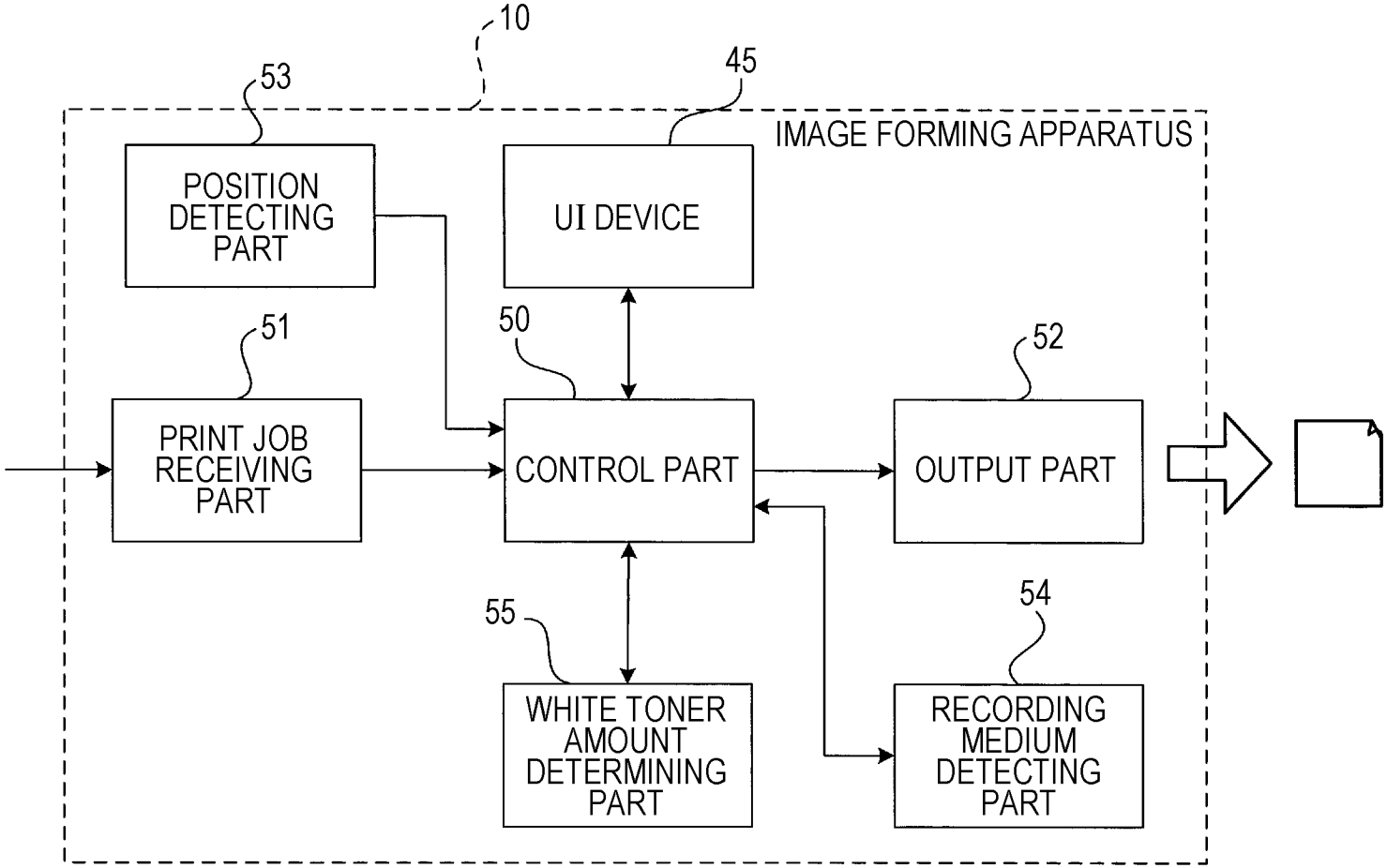
FIG. 8 is a block diagram illustrating the functional configuration of the image forming apparatus according to the exemplary embodiment of the present invention.

FIG. 8 is a block diagram illustrating the functional configuration of the image forming apparatus 10, which is implemented by executing the control program described above.

As illustrated in FIG. 8, the image forming apparatus 10 of this exemplary embodiment includes the UI device 45, a control part 50, a print job receiving part 51, an output part 52, a position detecting part 53, a recording medium detecting part 54, and a white toner amount determining part 55.

The UI device 45 is a device that allows a user to input an operation and displays various types of information for the user.

The print job receiving part 51 receives a print instruction from an external terminal apparatus or the like via the network.

The control part 50 executes printing by controlling the output part 52 based on the print job received by the print job receiving part 51.

The position detecting part 53 detects the mounting position of the image forming unit 12 for the white toner. Specifically, the position detecting part 53 detects whether the white toner is set at the end of the downstream side in the rotational direction of the intermediate transfer belt 14 with respect to the basic color toners so that the white toner image is formed after the basic color toner images have been formed, or the white toner is set at the end of the upstream side in the rotational direction of the intermediate transfer belt 14 with respect to the basic color toners so that the basic color toner images are formed after the white toner image has been formed.

The recording medium detecting part 54 detects the type of the recording medium based on the print job received by the print job receiving part 51 or the input to the UI device 45. For example, the recording medium detecting part 54 detects whether the recording medium to be subjected to printing is a film or paper based on a user's tray selecting operation.

The white toner amount determining part 55 determines the toner amount of the white toner based on the mounting position of the image forming unit 12 for the white toner that is a detection result from the position detecting part 53 and the type of the recording medium that is a detection result from the recording medium detecting part 54. That is, when the white toner image is formed as a background for the basic color toner images, the white toner amount determining part 55 determines the toner amount of the white toner to become smaller in the case in which the white toner image is formed in the lowermost layer on the recording medium as illustrated in FIG. 4 than in the case in which the white toner image is formed in the uppermost layer on the recording medium as illustrated in FIG. 6. Further, based on the type of the recording medium, the white toner amount determining part 55 determines the toner amount of the white toner to become smaller in the case in which the white toner image is formed in the lowermost layer on a film than in the case in which the white toner image is formed in the lowermost layer on paper.

Specifically, the white toner amount determining part 55 determines the toner amount of the white toner to be, for example, 80%, 90%, or 100% based on the position of the white toner (the mounting position of the image forming unit 12 for the white toner) and the type of the recording medium. That is, as illustrated in FIG. 9, the white toner amount determining part 55 determines the toner amount of the white toner to be 80% when the type of the recording medium is a film such as a transparent film and when the white toner is set at the end of the downstream side in the rotational direction of the intermediate transfer belt 14 with respect to the basic color toners (when the white toner image is formed in the lowermost layer on the transparent film). Further, the white toner amount determining part 55 determines the toner amount of the white toner to be 90% when the type of the recording medium is paper such as black paper other than white paper and when the white toner is set at the end of the downstream side in the rotational direction of the intermediate transfer belt 14 with respect to the basic color toners (when the white toner image is formed in the lowermost layer on the black paper). Still further, the white toner amount determining part 55 determines the toner amount of the white toner to be 100% when the type of the recording medium is a transparent film or the like and when the white toner is set at the end of the upstream side in the rotational direction of the intermediate transfer belt 14 with respect to the basic color toners (when the white toner image is formed in the uppermost layer on the transparent film).

The control part 50 performs control so that the toner amount of the white toner that is determined by the white toner amount determining part 55 is supplied when white is specified as a background color in the image on the print job received by the print job receiving part 51. Specifically, the control part 50 controls the toner amount of the white toner by controlling voltages to be supplied to the charging device 18 and the developing device 20, the light intensity of the optical scanning apparatus 24, and a current to be caused to flow through the first transfer roller 26. Further, the control part 50 controls the toner amount of the white toner in the image data received by the print job receiving part 51 by using a one-dimensional lookup table. That is, the control part 50 controls image forming parameters of the print engine 46 and white toner image data so that the toner amount of the white toner differs depending on the position where the white toner image is formed in the order of formation of the color toner images in the image forming units 12.

Next, the reason why toner splashing is suppressed during transfer and concealability is secured by controlling the toner amount of the white toner to change depending on the order of image formation and the type of the recording medium is described below with reference to results of experiments.

First, results of experiments in the toner splashing are described with reference to FIG. 10.

FIG. 10 illustrates a relationship among the type of the recording medium, the toner amount of the white toner, and the toner splashing during second transfer. In FIG. 10, the symbol "A" indicates "Excellent", the symbol "B" indicates "Good", and the symbol "C" indicates "Poor". The same applies to FIG. 12.

In the configuration in which the white toner image is formed in the lowermost layer on each of the transparent film and the black paper and is viewed from a side where the white toner image is formed as illustrated in FIG. 4, the toner splashing occurs during the second transfer when the toner amount of the white toner is 100% irrespective of whether the recording medium is the transparent film or the black paper. In the case of the black paper, the toner splashing during the second transfer is reduced when the toner amount of the white toner is 90%. In the case of the transparent film, the toner splashing occurs during the second transfer even when the toner amount of the white toner is 90% though the toner splashing is reduced compared with the case in which the toner amount of the white toner is 100%. The toner splashing is reduced when the toner amount of the white toner is 80%.

In the configuration in which the white toner image is formed in the uppermost layer on the transparent film and is viewed from a side opposite to a side where the white toner image is formed as illustrated in FIG. 6, the toner splashing does not occur during the second transfer irrespective of whether the toner amount of the white toner is changed to 100%, 90%, or 80%.

The toner amount of the white toner on the recording medium is increased by increasing the toner particle size compared with the toners such as the basic color toners other than the white toner so as to obtain a high concealability. Therefore, the toner splashing may be likely to occur due to poor transferability during the second transfer for the recording medium. Further, a film has a higher electrical resistance than paper. Therefore, the toner splashing may be likely to occur due to poor transferability. That is, the likelihood of the occurrence of the toner splashing may differ depending on the order of formation of the white toner image and the type of the recording medium.

Next, results of experiments in the concealability are described with reference to FIG. 11A to FIG. 12.

Figure 11A:
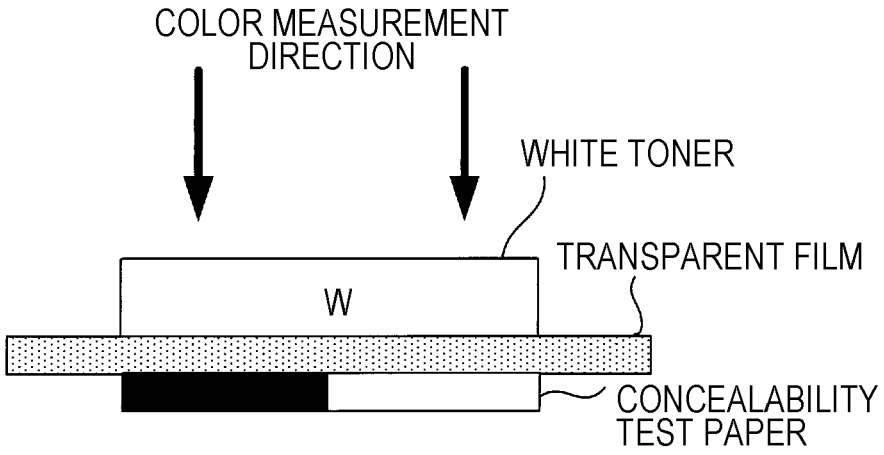
FIG. 11A illustrates a case in which a white toner image on a transparent film is viewed from a side where the white toner image is formed.
Figure 11B:
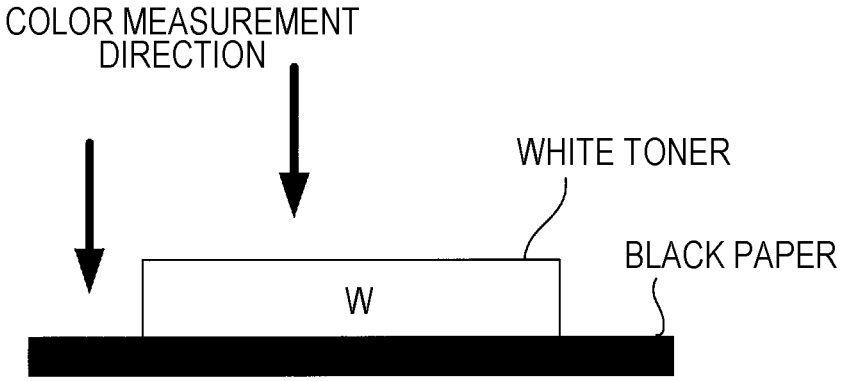
FIG. 11B illustrates a case in which a white toner image on black paper is viewed from a side where the white toner image is formed.
Figure 11C:
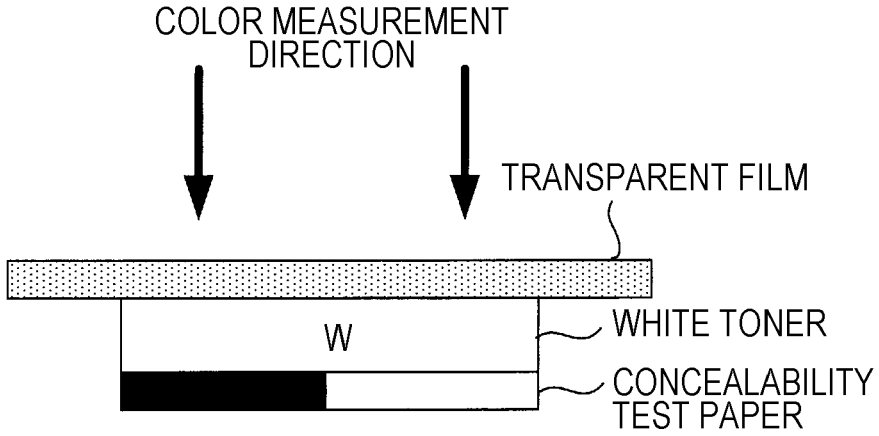
FIG. 11C illustrates a case in which the white toner image on the transparent film is viewed from a side opposite to the side where the white toner image is formed.

FIG. 11A illustrates a case in which a white toner image on a transparent film is viewed from a side where the white toner image is formed under the conditions that the toner amount of the white toner is 100%, 90%, and 80%. FIG. 11B illustrates a case in which a white toner image on black paper is viewed from a side where the white toner image is formed under the conditions that the toner amount of the white toner is 100%, 90%, and 80%. FIG. 11C illustrates a case in which the white toner image on the transparent film is viewed from a side opposite to the side where the white toner image is formed under the conditions that the toner amount of the white toner is 100%, 90%, and 80%. FIG. 12 illustrates a relationship among the type of the recording medium, the toner amount of the white toner, and the concealability as the results of the experiments in FIGS. 11A to 11C.

In the experiments illustrated in FIG. 11A and FIG. 11C, black and white concealability test paper is arranged under the transparent film in a color measurement direction. The concealability of the black part of the concealability test paper is visually checked from the side where the white toner image is formed in FIG. 11A and from the side opposite to the side where the white toner image is formed in FIG. 11C. The concealability refers to the degree of concealment of a color located in a layer below the white toner.

In the experiment illustrated in FIG. 11B, determination is made on the concealability by visually checking the white toner image on the black paper.

As illustrated in FIG. 12, in the configuration in which the white toner image is formed in the lowermost layer on the transparent film and is viewed from the side where the white toner image is formed as illustrated in FIG. 11A, the concealability in the case in which the toner amount of the white toner is 80% hardly changes compared with the cases in which the toner amount of the white toner is 100% and 90%. The reason may be as follows. When the white toner image is viewed from the side where the white toner image is formed, an effect of increasing the concealability is obtained by surface-reflected light from the toner even if the toner amount of the white toner is reduced.

In the configuration in which the white toner image is formed in the lowermost layer on the black paper and is viewed from the side where the white toner image is formed as illustrated in FIG. 11B, the concealability in the case in which the toner amount of the white toner is 80% is lower than those in the cases in which the toner amount of the white toner is 100% and 90%.

In the configuration in which the white toner image is formed in the uppermost layer on the transparent film and is viewed from the side opposite to the side where the white toner image is formed as illustrated in FIG. 11C, the concealability in the case in which the toner amount of the white toner is 80% is lower than those in the cases in which the toner amount of the white toner is 100% and 90%.

That is, when the toner amount of the white toner is reduced to about 80%, the toner splashing is unlikely to occur. When the toner amount of the white toner is reduced uniformly irrespective of the order of image formation and the type of the recording medium, however, the concealability may become difficult to maintain.

Next, the effect of increasing the concealability by the surface-reflected light from the white toner is described with reference to FIGS. 13A and 13B.

Figure 13A:
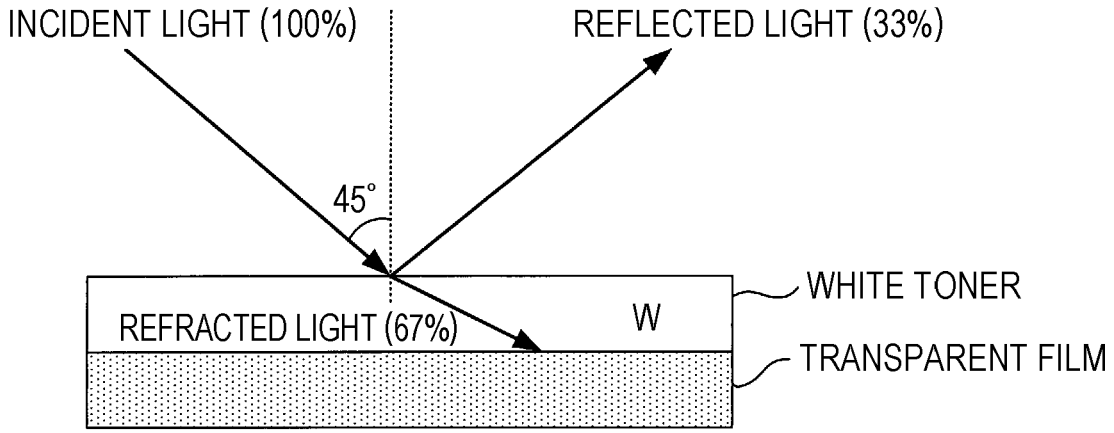
FIG. 13A illustrates concealability in the case in which the white toner image on the transparent film is viewed from the side where the white toner image is formed.

FIG. 13A illustrates concealability in the case in which the white toner image is formed on the transparent film and is viewed from the side where the white toner image is formed. FIG. 13B illustrates concealability in the case in which the white toner image is formed on the transparent film and is viewed from the side opposite to the side where the white toner image is formed.

A reflectance R of light that is incident from a medium A onto a medium B at an incident angle θ is calculated based on the following expression.

$$\text{Reflectance } R = \left( \frac{\cos\theta - \sqrt{n^2 - \sin^2\theta}}{\cos\theta + \sqrt{n^2 - \sin^2\theta}} \right)^2$$

In this expression, refractive index n=refractive index of medium B/refractive index of medium A.

A refractive index $n_a$ of air is 1.0 and a refractive index $n_b$ of a titanium oxide that is a material for the white toner is 2.74.

That is, when the white toner image is viewed from the side where the white toner image is formed as illustrated in FIG. 13A, 33% of light that is incident at an incident angle of 45° is reflected as surface-reflected light and 67% of the light is incident as refracted light at an interface between the white toner image and an air layer. That is, the surface-reflected light is about 33% when the white toner image is viewed from the side where the white toner image is formed.

Figure 13B:
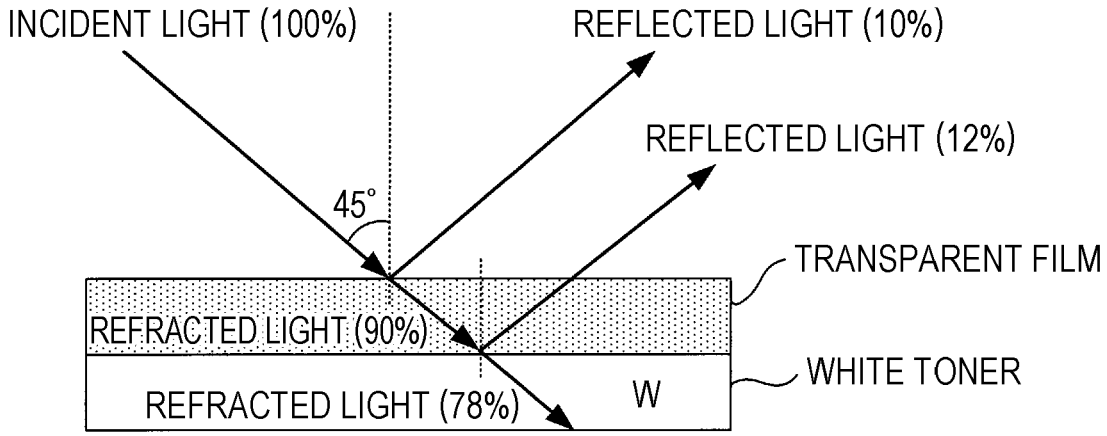
FIG. 13B illustrates concealability in the case in which the white toner image on the transparent film is viewed from the side opposite to the side where the white toner image is formed.

When the white toner image on the transparent film or the like is viewed from the side opposite to the side where the white toner image is formed as illustrated in FIG. 13B, 10% of the light that is incident at the incident angle of 45° is reflected as surface-reflected light and 90% of the light is incident as refracted light at an interface between the transparent film and the air layer. Further, 12% of the light is reflected as reflected light and 78% of the light is incident as refracted light at an interface between the transparent film and the white toner image. That is, the surface-reflected light is about 22% in total when the white toner image is viewed from the side opposite to the side where the white toner image is formed.

From the results of calculation described above, it is understood that the amount of surface-reflected light is larger, that is, the concealability is higher in the case in which the white toner image is viewed from the side where the white toner image is formed than in the case in which the white toner image is viewed from the side opposite to the side where the white toner image is formed. That is, when the white toner image is viewed from the side where the white toner image is formed, it is verified that the concealability is secured even if the toner amount of the white toner is reduced to about 80%.

MODIFIED EXAMPLES

The exemplary embodiment described above is directed to the case in which the image forming apparatus of the exemplary embodiment of the present invention is applied to the image forming apparatus that performs printing by using the white toner and the silver toner as the two special color toners. The image forming apparatus of the exemplary embodiment of the present invention is not limited thereto but is similarly applicable to a case of performing printing by using, for example, the white toner and the gold toner, the white toner and a clear toner, or the white toner and the white toner.

The exemplary embodiment described above is directed to the configuration in which the two special color toners are arranged at both ends of the array of the basic color toners. The configuration of the exemplary embodiment of the present invention is not limited thereto but is similarly applicable to a case of performing printing while the white toner that is one special color toner and is used as a background color is arranged at the end of the upstream or downstream side with respect to the basic color toners or the like. In place of the basic color toners, there may be used metallic toners such as gold, silver, and bronze toners or special color toners such as red, green, orange, and purple toners.

The exemplary embodiment described above is directed to the case in which the white toner image is formed as a background for an image formed by using the basic color toners or the like. The background color toner of the exemplary embodiment of the present invention is not limited thereto but is similarly applicable to a case of performing printing by using, for example, a pale background color toner such as a light blue or pink toner that may be used as a background for an image formed by using the basic color toners or the like.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming component configured to form an image on a recording medium by using a white color material and a color material other than the white color material, and a controller configured to form a color material amount of the white color material to differ depending, on a position where an image that uses the white color material is formed in order of formation of images that use respective color materials in the image forming component.

2. The image forming apparatus according to claim 1, wherein the controller is further configured to control the color material amount of the white color material to differ between a case in which the image that uses the white color material is formed after an image that uses the color material other than the white color material has been formed in the image forming component and a case in which the image that uses the color material other than the white color material is formed after the image that uses the white color material has been formed in the image forming component.

3. The image forming apparatus according to claim 2, wherein the controller is further configured to control the color material amount of the white color material to become smaller in a case in which the image that uses the color material other than the white color material is formed above the image that uses the white color material on the recording medium than in a case in which the image that uses the white color material is formed above the image that uses the color material other than the white color material on the recording medium.

4. The image forming apparatus according to claim 1, wherein the controller is further configured to control, when a plurality of image forming units for the respective color materials are mounted on the image forming component, the color material amount of the white color material to differ depending on a position of an image forming unit where the white color material is set.

5. The image forming apparatus according to claim 4, wherein the controller is further configured to control the color material amount of the white color material to become smaller in a case in which an image that uses the color material other than the white color material is formed above the image that uses the white color material on the recording medium than in a case in which the image that uses the white color material is formed above the image that uses the color material other than the white color material on the recording medium.

6. The image forming apparatus according to claim 1, wherein the recording medium is formed of a material through which the image is formed by using the respective color materials is viewable from a side opposite to a side where the image is formed.

7. The image forming apparatus according to claim 6, wherein the recording, medium is a transparent film-like sheet.

8. The image forming apparatus according to claim 1, wherein the controller is further configured to control the color material amount of the white color material to differ depending on a type of the recording medium.

9. The image forming apparatus according to claim 8, wherein the controller is further configured to control, when an image that uses the color material other than the white color material is formed above the image that uses the white color material on the recording medium, the color material amount of the white color material to become smaller in a case in which the images are formed on a film than in a case in which the images are formed on paper.

10. The image forming apparatus according to claim 1, wherein a toner particle size of the white color material is bigger than a toner particle size of the color material other than the white color material.

11. A non-transitory computer readable medium storing a program causing a computer to execute a process comprising:

forming an image on a recording medium by using a white color material and a color material other than the white color material; and controlling a color material amount of the white color material to differ depending on a position where an image that uses the white color material is formed in order of formation of images that use respective color materials.

12. An image forming apparatus, comprising:

image forming means for forming an image on a recording medium by using a white color material and a color material other than the white color material; and control means for controlling a color material amount of the white color material to differ depending on a position where an image that uses the white color material is formed in order of formation of images that use respective color materials in the image forming means.

* * * * *